US007775228B2

(12) United States Patent
Clark

(10) Patent No.: US 7,775,228 B2
(45) Date of Patent: Aug. 17, 2010

(54) PERSONAL EASY LIFTING DEVICE

(75) Inventor: Michael W. Clark, Arcanum, OH (US)

(73) Assignees: Sheldon A. Kopin, Cincinnati, OH (US); Vivian C. Kopin, Cincinnati, OH (US)

( * ) Notice: Subject to any disclaimer, the term of this patent is extended or adjusted under 35 U.S.C. 154(b) by 0 days.

(21) Appl. No.: 12/390,043

(22) Filed: Feb. 20, 2009

(65) Prior Publication Data

US 2010/0078052 A1 Apr. 1, 2010

Related U.S. Application Data

(60) Provisional application No. 61/100,779, filed on Sep. 29, 2008.

(51) Int. Cl.
*A61H 3/00* (2006.01)

(52) U.S. Cl. ..... 135/66; 135/67; 5/81.1 R; 5/662; 297/411.7

(58) Field of Classification Search ..... 135/66–67, 135/75; 5/662, 503.1, 81.1 R, 425–426, 5/83.1; 297/5–6, 411.7, 411.2, 3
See application file for complete search history.

(56) References Cited

U.S. PATENT DOCUMENTS 2,773,542 A 12/1956 Chasin
3,272,530 A * 9/1966 Klassen ..... 280/79.2
3,739,793 A 6/1973 Wilson
4,314,576 A * 2/1982 McGee ..... 135/67
4,869,279 A 9/1989 Hedges
5,226,439 A 7/1993 O'Keeffe et al.
5,384,927 A * 1/1995 Mardero et al. ..... 5/662
5,397,169 A 3/1995 Willans
5,449,013 A * 9/1995 Landers ..... 135/67
5,465,744 A * 11/1995 Browning ..... 135/67
5,509,432 A 4/1996 Peterson
5,560,053 A * 10/1996 Mills ..... 5/81.1 R
5,904,168 A * 5/1999 Alulyan ..... 135/65
5,983,421 A 11/1999 Walser
5,983,911 A * 11/1999 Steele ..... 135/66
6,134,731 A 10/2000 Thom et al.
6,138,301 A 10/2000 Battiston
6,244,285 B1 * 6/2001 Gamache ..... 135/67
6,332,232 B1 12/2001 Neal
6,860,281 B1 * 3/2005 Clift ..... 135/67
6,926,365 B2 * 8/2005 Bottoms ..... 297/423.12
7,181,788 B2 * 2/2007 Flannery et al. ..... 5/430

* cited by examiner

*Primary Examiner*—Winnie Yip
(74) *Attorney, Agent, or Firm*—Wood, Herron & Evans, LLP

(57) ABSTRACT

A personal easy lifting device has mounting units with adjustable legs forward of handle members and supports to facilitate positioning forward aspects of the supports in close proximity to a firm edge of an article of furniture with which the device is to be used to assist a person in rising, such as from a sitting position, from an article of furniture to a standing position.

15 Claims, 5 Drawing Sheets

PERSONAL EASY LIFTING DEVICE

CROSS REFERENCE TO RELATED APPLICATIONS

This application claims priority to Provisional U.S. Patent Application Ser. No. 61/100,779 filed Sep. 29, 2008, now pending, the disclosure of which is incorporated by reference herein in its entirety.

FIELD OF THE INVENTION

The present invention relates to devices in the nature of a portable frame for use by individuals to help them rise from a sitting position such as from an article of furniture.

BACKGROUND OF THE INVENTION

There are many people who have physical difficulty rising out of a sitting position from pieces of furniture. This difficulty is often associated with injury or age. Many devices have been developed to assist people with this task, but a particularly simple, lightweight, and easy to use device is the portable frame provided by Neal U.S. Pat. No. 6,332,232, the disclosure of which is incorporated herein by reference as if set out in its entirety. That device is intended to be used with an article of furniture having a firm edge along a side thereof with a gap between that firm edge and the floor. The device includes a pair of generally horizontal supports each having a rearward aspect adapted to rest on the floor surface and sized to be received through the gap under the article of furniture. The device also includes a pair of spaced-apart vertically oriented handle members coupled to the support members with an upper aspect defining generally horizontally extending handles for grasping by the user. Lower aspects of the handle members are coupled to forward aspects of the supports to define a junction having a generally horizontal portion and a generally vertical portion. When the device is situated with the supports resting on the floor surface under the article of furniture and thus extending through the gap, the handle members extend up in front of the firm edge to locate the handles in position for the person to grasp and obtain leverage to rise from a sitting position on the furniture between the handle members.

Where the gap between the floor surface and the firm edge is small, such as close to the thickness or height of the supports, the device will naturally stabilize against the furniture to provide desired and reliable leverage for the person to lift themselves from the sitting position. Where the gap is much larger, however, stabilization may not occur such that the user might find the device difficult or problematic in use. In the Neal patent, such issues are resolved by provision of brackets associated with the handle members which can be adjusted vertically along the handle members to couple to the firm edge of the article of furniture, thus providing the desired stabilization.

While the device of the Neal patent is quite advantageous, some improvements are desired. By way of example, some may prefer not to use the brackets, especially where there might be concern that the firm edge, or perhaps fabric associated with that edge (such as a wrap or a skirt of upholstery fabric), might be damaged or otherwise adversely affected by the brackets.

SUMMARY OF THE INVENTION

The present invention provides an improved personal easy lifting device which provides leverage without brackets even for articles of furniture with a large gap between the firm edge and the floor surface. To that end, and in accordance with the principles of the present invention, the device is provided with a pair of mounting units secured to and extending forwardly of the junction of the handle members and supports, each mounting unit having associated therewith an adjustable leg extending to the floor surface such that the forward aspects of the supports are held off the floor surface by a distance determined by adjustment of the legs to facilitate positioning the forward aspects in close proximity to the firm edge of the article of furniture. As a consequence, the supports can be brought into close proximity with the firm edge of the article of furniture to thus gain desired leverage without the need for brackets.

The adjustable legs may have a portion exposed below the support to facilitate adjustment from below. Advantageously, the adjustable legs may also have an accessible top end to facilitate adjustment from above. To that end, each mounting unit may have an upper access aperture through which the top end of the respective adjustable leg may be accessed for adjustment from above.

By virtue of the foregoing, there is thus provided an improved personal easy lifting device which provides leverage without brackets even for articles of furniture with a large gap between the firm edge and the floor surface. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
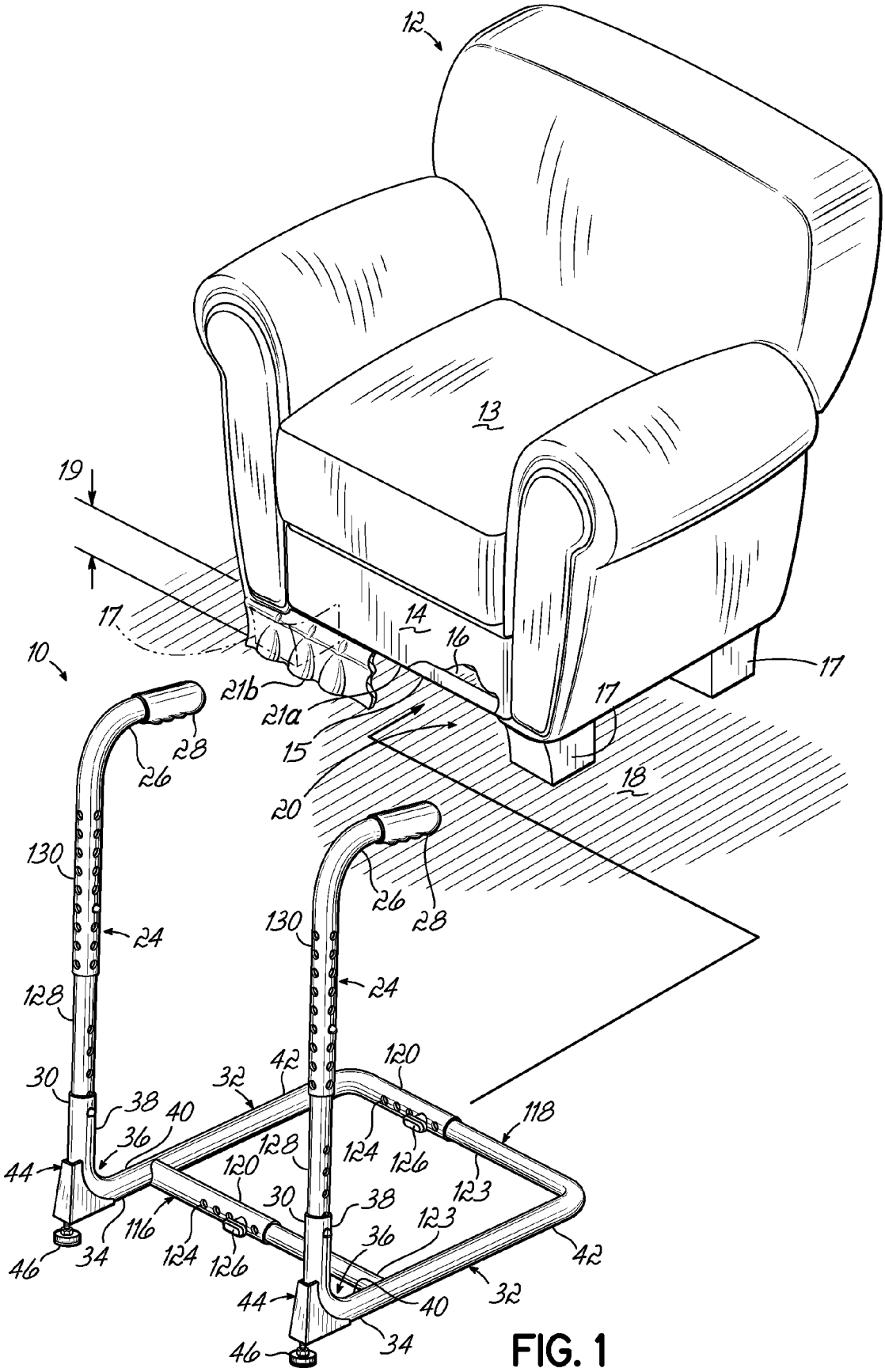
FIG. 1 is an exploded perspective view of an exemplary article of furniture, partially cut-away, and a first embodiment of a personal easy lifting device incorporating features of the present invention for purposes of explaining principles of the present invention.
Figure 2:
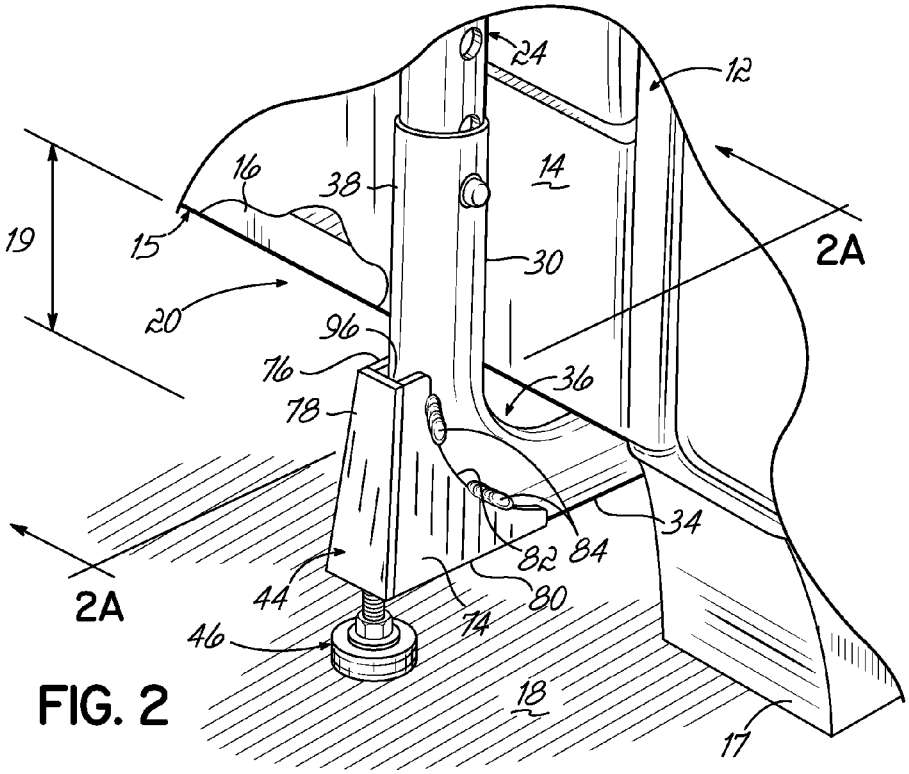
FIG. 2 is an enlarged, perspective view showing portions of the personal easy lifting device and article of furniture of FIG. 1 situated for use.

With reference to FIGS. 1 through 4B, there is shown a first embodiment 10 of a personal lifting device for use with an exemplary article of furniture 12. As best seen in FIGS. 1 and 2, article of furniture 12 has a seating surface 13 such as defined by a top face of a cushion, mattress or the like, a face 14 such as a front or side face extending down from the seating surface to a firm edge 15, such as might be defined by a frame or brace piece 16 extending across at least a lower-most aspect of face 14. Article of furniture 12 also has legs 17 (only two shown in FIG. 1) which rest on a floor surface 18 (such as hardwood or carpet), so as to position firm edge 15 above the floor surface at a height 19 thereby defining a gap 20 therebetween. Firm edge 15 might be an exposed, and finished, piece of metal or wood defined by frame or brace piece 16, although in the embodiment shown herein, upholstery fabric 21 is associated with and thus is part of firm edge 15, such as by a wrap portion 21*a* thereof wrapped about firm edge 15 and/or a skirt portion 21*b* thereof extending down thereover towards floor surface 18.

As will be readily understood, a person (not shown) may be positioned in a sitting position with their torso extending above the seating surface 13, and their leg limbs extending out therefrom over face 14 and down towards floor surface 18. The person's feet (whether or not shod), may be resting on floor surface 18. To help that person rise from the sitting position, personal lifting device 10 is provided for use with article of furniture 12.

Personal easy lifting device 10 has a pair of spaced-apart generally vertically oriented handle members 24 each having an upper aspect 26 defining generally horizontally extending handles 28 and a lower aspect 30. A pair of generally horizontal supports 32 each having a forward aspect 34 connects to the lower aspect 30 of a respective handle member so as to define a junction 36 having a generally vertically extending portion 38 and a generally horizontal extending portion 40. The horizontally extending portions 40 are shown as being defined by supports 32, but could alternatively be defined by handle members 24. Generally vertically extending portions 38 are also shown as being defined by supports 32 and including portions of vertically oriented handle members 24, but could alternatively be defined by vertically oriented handle members 24. Each support 32 also has a rearward aspect 42. Supports 32 are sized to fit through gap 20 and extend under article of furniture 12 such as below seating surface 13 with the forward aspects 34 adjacent firm edge 15 and the rearward aspects 42 extending rearwardly from firm edge 15 and along floor surface 18 (see, e.g., FIGS. 2, 4A, and 4B).

Figure 2A:
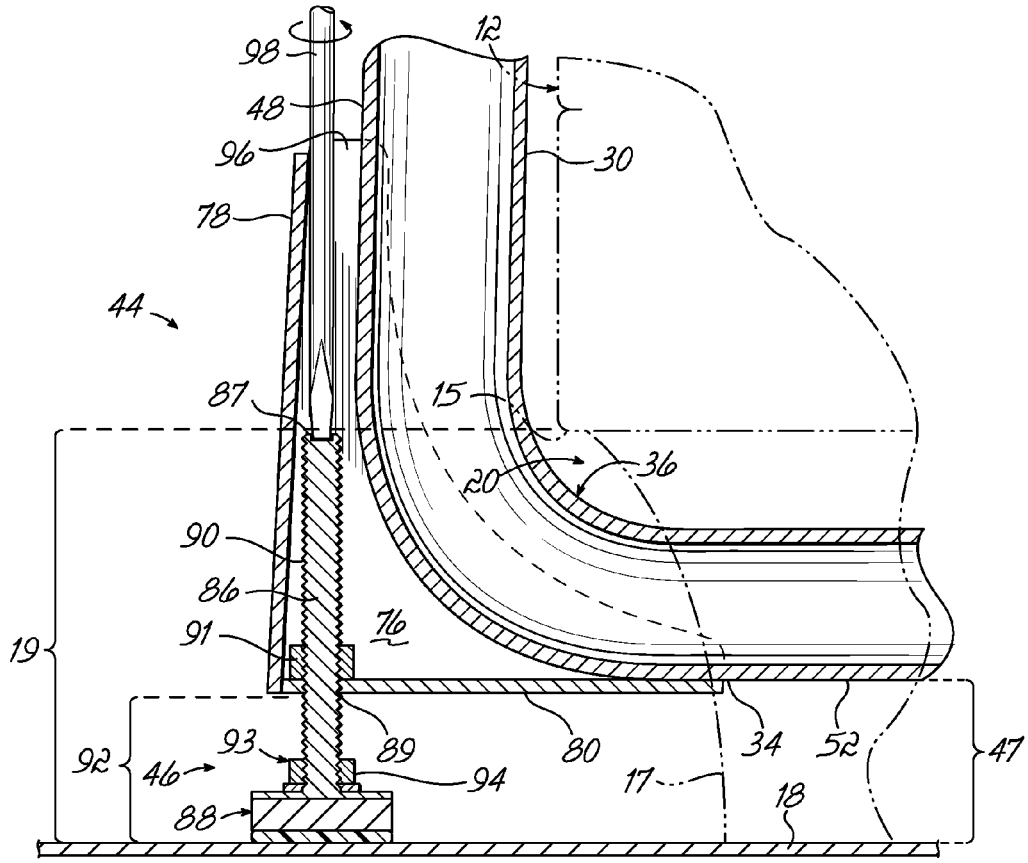
FIG. 2A is a partial view, in cross-section, of the personal easy lifting device of FIG. 1 taken along lines 2A-2A of FIG. 2.
Figure 3:
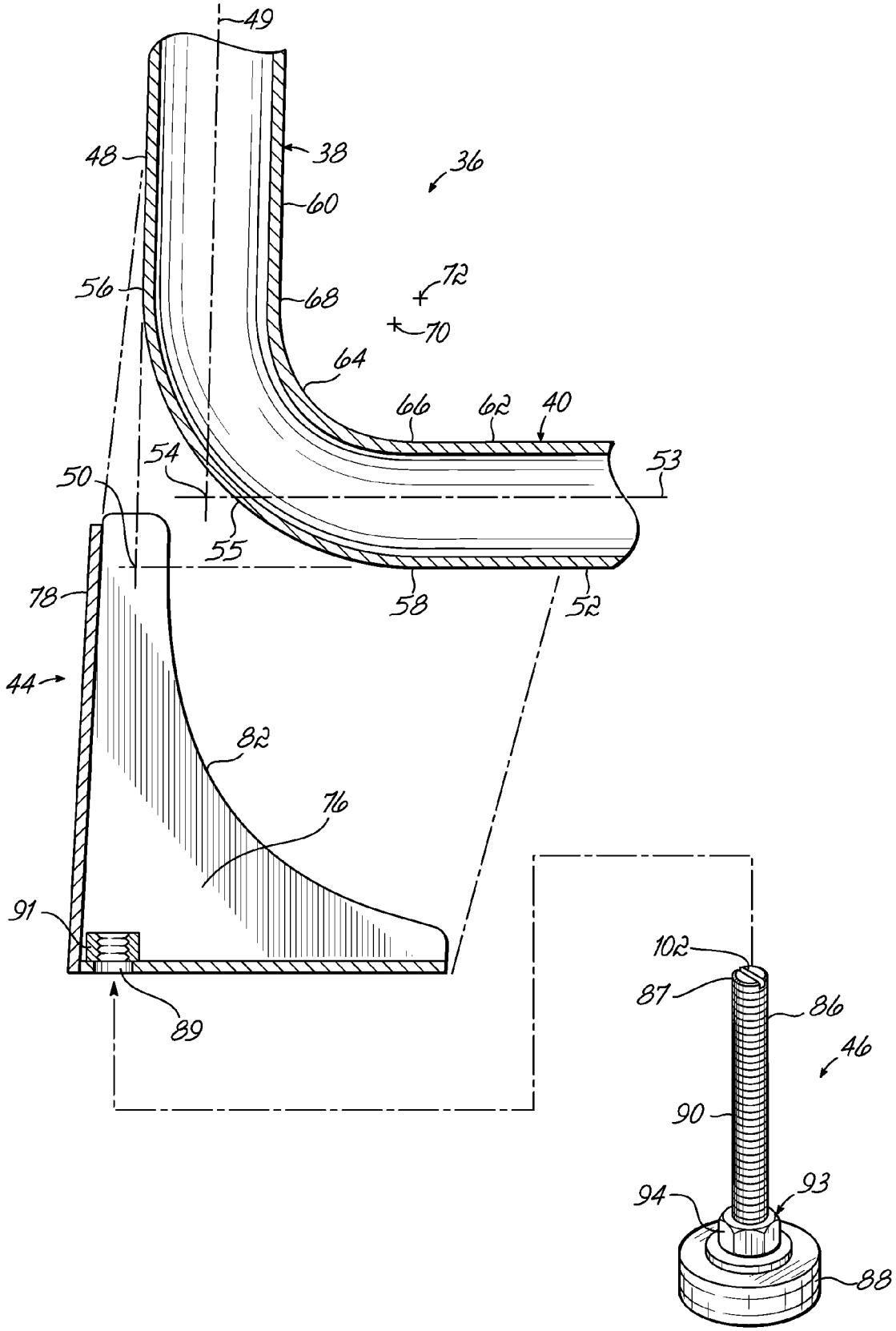
FIG. 3 is an exploded view of FIG. 2A with the adjustable leg shown in full perspective.

As best seen in FIGS. 2, 2A and 3, device 10 also includes a pair of mounting units 44, each secured to and extending forwardly of a respective junction 36. A pair of adjustable legs 46 are provided, each associated with a respective mounting unit 44. Legs 46 extend to floor surface 18 forward of vertically oriented handle members 24. The forward aspect 34 of each support 32 is held off or above floor surface 18 a distance 47 (FIG. 2A) by the associated adjustable leg 46, with each leg 46 advantageously being adjusted to position forward aspect 34 in close proximity to firm edge 15 as will be described.

In the embodiment illustrated, junction 36 is made of round metallic tubing. As seen best in FIG. 3, generally vertically extending portion 38 has a forward edge 48 and a vertical center axis 49. Similarly, horizontal extending portion 40 has a bottom edge 52 and a horizontal center axis 53. A projection of forward edge 48 and bottom edge 52 meet at a projected edge intersection point 50. Likewise, a projection of vertical center axis 49 and horizontal center axis 53 meet at a projected centerline intersection point 54. An outside radius 55 meets forward edge 48 at point 56 and bottom edge 52 at point 58. Vertically extending portion 38 has a rear edge 60 and horizontal extending portion 40 has a top edge 62. An inside radius 64 meets top edge 62 at a point 66 and rear edge 60 at a point 68. The center of inside radius 64 is a point 70 and the center of outside radius 55 is a point 72.

As is typical, the part of inside radius 64 that is closer to point 68 has a steeper vertical slope than the part of inside radius 64 that is closer to point 66. The size of outside radius 55 and inside radius 64 are chosen within the limits of tube bending, for the given size, material, and wall thickness. In general, round tubing must be bent within certain limitations to avoid crimps, tears, and thinning that would make the tubing weak. When bending a piece of tubing from horizontal to vertical (such as at or near 90 degrees), it is not desirable to have a very small radius, nor are sharp inside or outside corners easily obtained. Thus, the tubing may not extend to the projected edge intersection point 50.

Each mounting unit 44 has a left side 74, a right side 76, a front side 78, and a bottom side 80. These sides need not be solid, but may have perforations or cut outs as long as they are strong enough to support the weight they will be subjected to in use. Right side 76 and left side 74 are spaced apart to receive at least a portion of junction 36 to make a close fit. For tubing of one inch nominal diameter the spacing is approximately 1.04 inches. A radius 82 of approximately 3.34 inches is consistent with outside radius 55 and inside radius 64. Mounting unit 44 is welded or otherwise attached to the junction 36. Welds 84 are visible on the left side 74 and similar welds (not visible) are on the right side 76, and it is understood that mounting unit 44 may be fastened to the junction 36 in ways other than welding.

Each adjustable leg 46 extends from bottom side 80 of a respective mounting unit 44. To that end, adjustable leg 46 has a threaded shaft 86 extending between upper end 87 and a foot portion 88, the latter adapted to rest against floor surface 18. Shaft 86 extends through an aperture 89 in bottom side 80 of mounting unit 44 so that its threads 90 engage into a threaded body 91, such as a nut, affixed to bottom side 80 (FIG. 3). Threaded body 91 is advantageously affixed to mounting unit 44 in a way that prevents rotation relative thereto. With shaft 86 threadably engaged with threaded body 91, a portion 92 of shaft 86, such as adjacent foot portion 88, is exposed below mounting unit 44. Exposed portion 92 may include a nut 93 or other element affixed thereto or defined thereon so as to define flats 94, for example, which can be gripped by hand or a wrench (not shown) to rotate shaft 86 and thus adjust the position of foot portion 88 relative to bottom side 80.

Additionally, mounting unit 44 may have an access aperture 96 sized to fit a tool 98 to access upper end 87 of threaded shaft 86 from above. Tool 98 may be in the form of a screwdriver, a socket wrench, or the like consistent with a tool feature 102 (shown here as a slot to accept a flat blade of a screwdriver) provided on upper end 87 of leg 46.

Figure 4A:
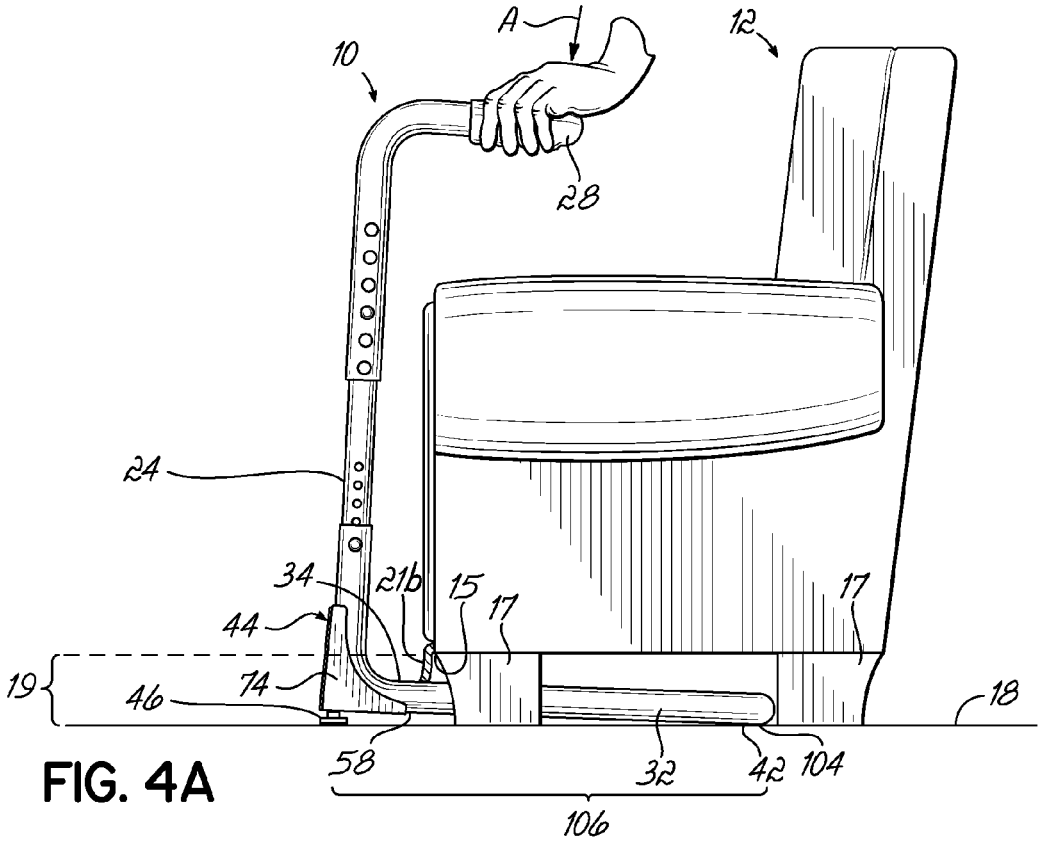
FIGS. 4A and 4B are side views of the personal easy lifting device and article of furniture of FIG. 1 showing various states thereof for purposes of explaining principles of the present invention.

Use and operation of device 10 in relation to article of furniture 12 will be described by reference to FIGS. 4A and 4B. To that end, FIG. 4A illustrates personal lifting device 10 brought near article of furniture 12 with adjustable legs 46 not extended, yet in contact with floor 18. In particular, foot portions 88, and rearward aspects 42 of generally horizontally extending portion 40 as at 104, will rest against floor surface 18. A length of support 106 will extend from location 104 forward to leg 46 that is forward of projected edge intersection point 50. In comparison, a junction 36 without a mounting unit 44, would have point 58 as its most forward point in contact with floor surface 18. The more forward leg 46 is advantageous because if a person lifting themselves puts their weight on handles 28 in an approximately downward and forward direction as indicated by the arrow A, vertically oriented handle members 24 carry the weight to adjustable legs 46 to more effectively transmit that weight to the floor surface 18.

Because it is advantageous to have forward aspects 34 adjacent to firm edge 15 rather than spaced therefrom as is the case in FIG. 4A, legs 46 are extended from mounting unit 44 by grasping and turning foot portion 88 or nut 93, or by using tool 98 in tool feature 102, to expose a greater portion 92 of leg 46 thus elevating forward aspect 34 closer towards, and possibly into contact with, firm edge 15.

Figure 4B:
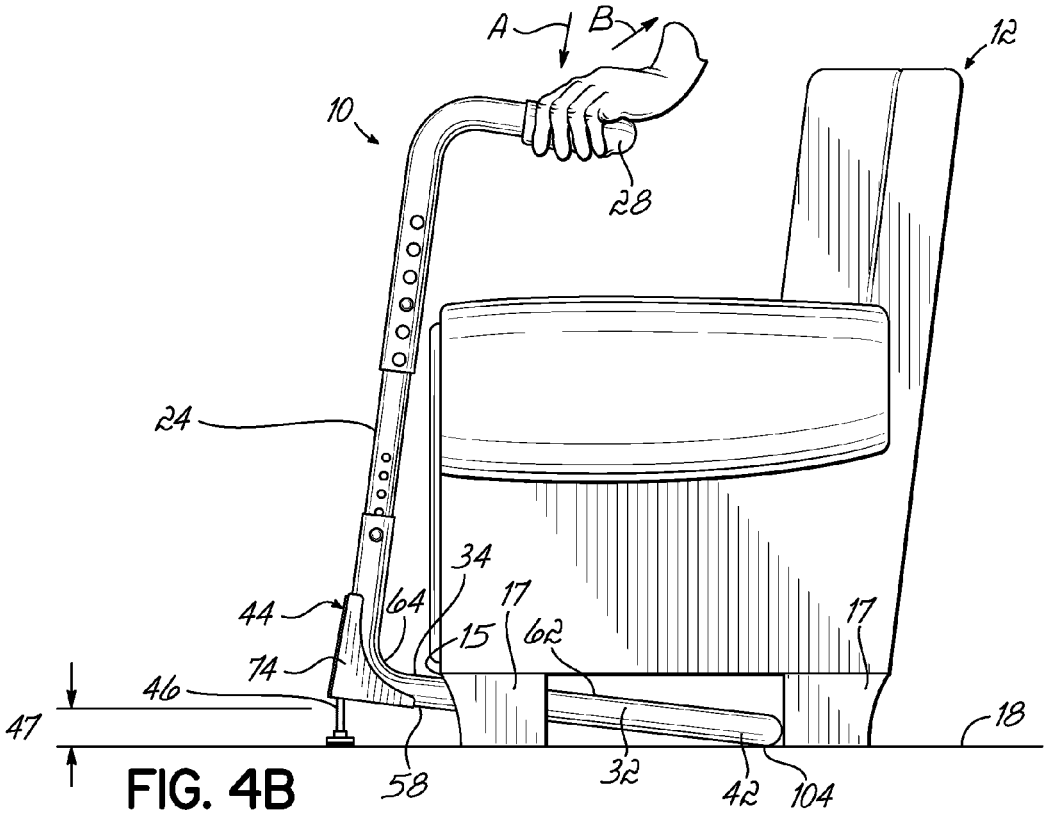

FIG. 4B illustrates full use of personal lifting device 10. When placed and adjusted next to article of furniture 12, extended adjustable legs 46 hold forward aspects 34 off from floor surface 18 the distance 47, positioning forward aspects 34 in close proximity (and possibly contacting) to firm edge 15. A person (not shown) sitting on seating surface 13 and wishing to rise from article of furniture 12 grasps handles 28, to gain leverage. While grasping handles 28, the person may push down with their weight as indicated by arrow A, or may pull upward, rearward, or a combination of the two, as indicated by arrow B.

If a person puts their weight on the handles as indicated by arrow A, the weight is transmitted directly to the floor through adjustable legs 46 that are positioned in line with or forward of vertical handle members 24. Advantageously, since adjustable legs 46 are extended, vertically oriented handle members 24 tilt back into the area over seating surface 13, making horizontal handles 28 slightly lower and more rearward when compared to FIG. 4A. This tilting can further enhance forward tip resistance.

If a person pulls upward or backward on handles 28 as indicated by arrow B, any movement of device 10 is quickly arrested by forward aspects 34 bearing against or moving into contact with firm edge 15 on the inside radius 64 near point 66, or along the top edge 62 or the rear edge 60 near point 68. Rising from a sitting position is thus accomplished effectively with device 10, and can be achieved with less risk of damage to firm edge 15 (either frame or brace piece 16 if exposed or fabric 21 if present). It will be noted that while handle members 24 are shown spaced from face 14 of article of furniture 12 in FIGS. 4A and 4B, the handle members could be spaced more closely and possibly even brought into contact with face 14 as desired.

A person using device 10 will thus obtain the desired leverage, but without requiring a bracket. Indeed, forward aspect 34 will or can bear against firm edge 15 without necessarily damaging the finish of firm edge 15 and/or fabric 21 associated therewith (whether wrap 21*a* or skirt 21b, although the latter may be temporarily bunched up or wrinkled by device 10 in use).

Returning to FIG. 1, additional components of personal easy lifting device 10 include a forward cross member 116 and an aft cross member 118. Tubes 120 of a larger diameter and tubes 123 of a smaller diameter engage and are interlocked by the use of holes 124 and pins 126 to adjust the distance between the horizontal extending portions 40. The distance is small enough to fit between the furniture legs 17. The adjustability also controls the spacing between the vertically oriented handle members 24. Similarly, the vertically oriented handle members 24 have adjustability so that handles 28 may be placed at a chosen height relative to the seating surface 13. This also is done by using slidably interlocking tubes with pins. In the embodiment shown, vertical handle members 24 include a smaller diameter extension 128 that slides inside a larger diameter junction 36 and a larger diameter portion 130 of vertical handle member 24.

Figure 5:
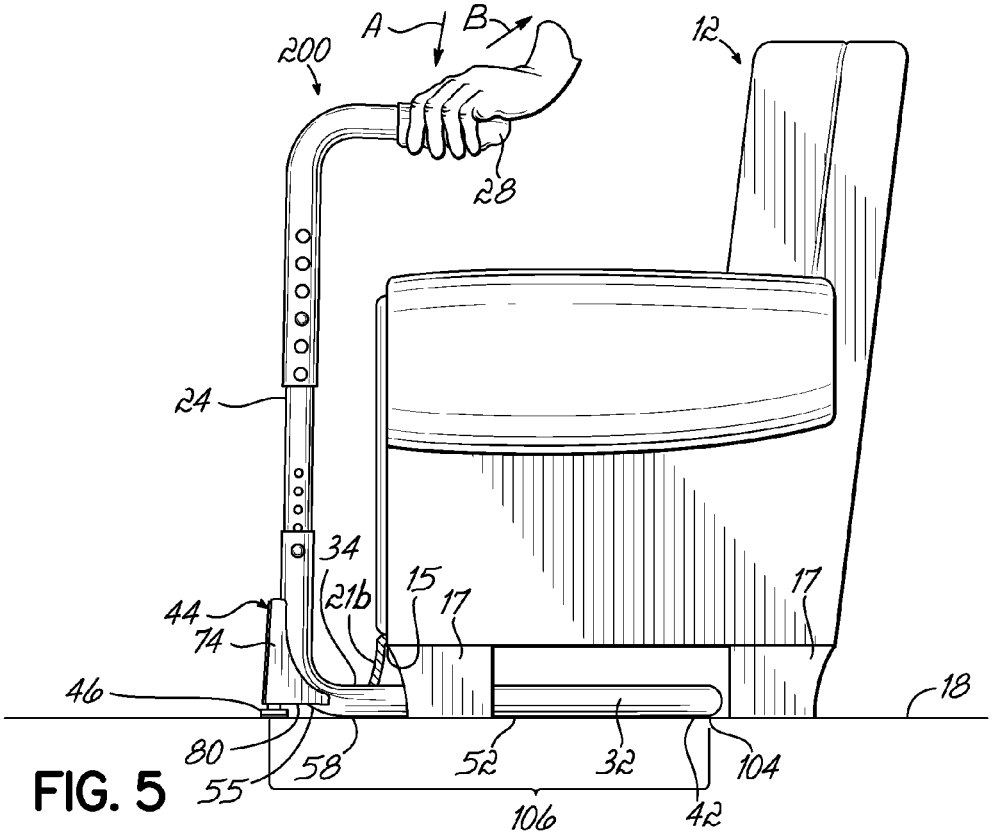
FIG. 5 is a schematic view of a second embodiment of a personal easy lifting device with the article of furniture of FIG. 1 showing a state thereof for purposes of explaining principles of the present invention.

FIG. 5 illustrates a second embodiment of a personal lifting device 200 in accordance with principles of the present invention. Device 200 is very much like device 10 and differs in that the pair of mounting units 44 are secured to the junction 36 vertically higher than in the device 10, bringing bottom side 80 above bottom edge 52. In this embodiment, it is possible to extend the legs 46 such a small amount that the entire horizontal support 32 from a rear most point 104 to point 58 is resting on floor surface 18. Forward tipping and rotation around point 58 could begin, but would be arrested when leg 46 contacts floor 18. If legs 46 were extended to raise horizontal supports 32 off from floor surface 18, device 200 would operate and be used in the same manner as described above in regard to device 10.

Figure 6:
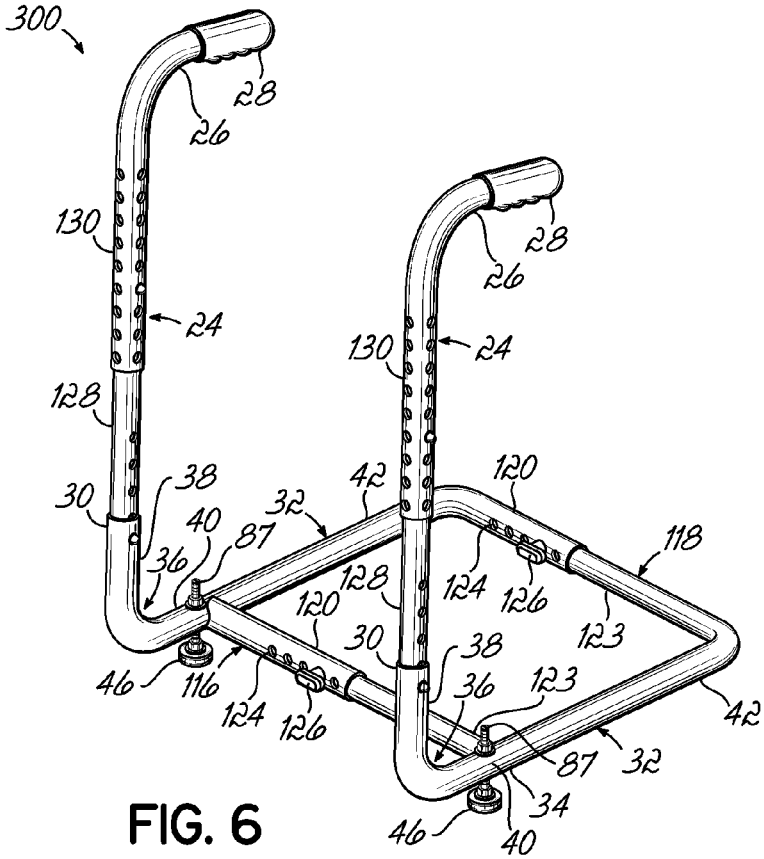
FIG. 6 is a perspective view of a third embodiment of a personal easy lifting device incorporating alternative features of the present invention.

In a third embodiment 300 of a personal easy lifting device in accordance with principles of the present invention, as shown in FIG. 6, mounting units 44 are dispensed with and adjustable legs 46 are instead installed in horizontal supports 32 with the upper ends 87 thereof exposed to facilitate adjustment from above, as well as from below as in the case of device 10. Alternatively, legs 46 may be installed in another location that facilitates positioning forward aspects 34 in close proximity to firm edge 15, such as junction 36 or forward cross member 116.

In use, personal easy lifting devices in accordance with principles of the present invention, such as devices 10, 200, or 300, are set-up for an article of furniture 12 as follows. Width is adjusted by way of pins 126 so that horizontal supports 32 are close enough together to fit between legs 17, while handles 28 are comfortable for a user to pass between and grip for support. The height of handles 28 may be adjusted to the preferences of the user by slidably adjusting extension 128 within vertical handle member 24. This adjustment may be done during initial set-up, or at any time while the device is installed at the article of furniture 12. Handles 28 are usually oriented towards the seating surface 13, but may be pointed directly away from seating surface 13, or rotated to an orientation 90 degrees to the generally horizontal extending portion 40, to suit user preference.

Legs 46 are extended from mounting unit 44 an amount that the inside radius 64, preferably close to point 66, is at a height just below (or at) firm edge 15 of article of furniture 12. Supports 32 are slid under article of furniture 12 through gap 20 below firm edge 15. Legs 46 may be further adjusted to bring forward aspects 34 in closer proximity to firm edge 15 once in position. Legs 46 can be adjusted again once in place, or could have been adjusted with device 10 in place as seen in FIG. 4A.

When a person wishes to sit in the article of furniture 12, they come to a position close to handle members 24, turn themselves so their back is to seating surface 13, and lower themselves through the handle members 24. The person could grasp handles 28 to assist in that seating maneuver. When a person wishes to rise from the seating surface 13, they may grasp handles 28 and use their upper body strength to assist lifting their body from seating surface 13. On lifting, the person's torso passes through handle members 24, and the person can thereafter release their hold on handles 28, and move away from the article of furniture leaving device 10 (or 200 or 300) in place at article of furniture 12. The device 10 can also be moved to another article of furniture for use therewith as desired. In that regard, personal lifting device 10 is advantageously portable, weighing approximately 13 pounds. Further, it may be quickly disassembled such as at pins 126 to make it easier to transport.

By virtue of the foregoing, there is thus provided an improved personal easy lifting device which provides leverage without brackets even for articles of furniture 12 with a large gap 20 between firm edge 15 thereof and floor surface 18 therebelow.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, the device has been described by embodiments that use circular metal tubing cut in a particular number of pieces of smaller and larger diameter. But, the basic structure and its manufacture may be varied. For example, although supports 32 which fit under article of furniture 12 are shown as part of a rectangular frame aspect of adjustable width, it could also be another shape, and it could be non-adjustable. The transitions from horizontal near floor surface 18 to vertical extending away therefrom could take on different shapes, and may not be of the same material as the other parts.

For example, junction 36 could be of molded plastic shaped to engage straight pieces of tubing. Similarly, while the present invention advantageously avoids the need for brackets, they may still be used, with the adjustable legs providing a better range of adjustments to better make use of the brackets where desired. Further, article of furniture 12 used by example here was for purposes of explaining principles of the present invention. Device 10, for example, could be used with an article of furniture that lacks fabric 21, and instead presents only a finished firm edge, such as by painted or stained frame or brace piece 16. Alternatively, firm edge 15 could simply have wrap upholstery fabric 21a. Similarly, while article of furniture 12 is shown as a chair, it could be a sofa, bed, or other article of furniture as will be readily appreciated. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. A personal lifting device for use with an article of furniture having a surface on which a person can sit and a firm edge along a side of the article below the surface spaced a distance from a floor surface on which the article of furniture is resting so as to define a gap between the firm edge and said floor surface, the personal lifting device comprising:

a pair of spaced-apart generally vertically oriented handle members each having an upper aspect defining a generally horizontally extending handle and a lower aspect;

a pair of generally horizontal supports each having a forward aspect connected to the lower aspect of a respective handle member so as to define a junction having a portion extending generally vertically and a portion extending generally horizontally, each support also having a rearward aspect, the supports sized to be received through said gap to extend under said surface of said article of furniture with the forward aspects adjacent said firm edge and the rearward aspects extending rearwardly therefrom and along said floor surface;

a pair of mounting units each being secured to and extending forwardly of a respective junction; and a pair of adjustable legs each being associated with a respective mounting unit so as to extend to said floor surface forwardly of the handle members such that the forward aspects of the supports are held off said floor surface by a distance determined by adjustment of the legs whereby to facilitate positioning the forward aspects in close proximity to said firm edge.

2. The device of claim 1, each adjustable leg having a portion exposed below the mounting unit to facilitate adjusting the leg from below.

3. The device of claim 2, each mounting unit having an access aperture situated so as to provide adjustment access to its associated adjustable leg to facilitate adjusting the leg from above.

4. The device of claim 1, each mounting unit having an access aperture situated so as to provide adjustment access to its associated adjustable leg to facilitate adjusting the leg from above.

5. The device of claim 1 wherein the junction is made of a continuous piece of tubing bent to have a substantially continuous radius.

6. The device of claim 5 wherein the substantially continuous radius is at least three inches.

7. The device of claim 6 wherein the mounting unit has the substantially continuous radius of claim 6 along an edge that is welded to the continuous piece of tubing.

8. The device of claim 1 wherein the generally horizontal supports are connected by at least one cross member of adjustable length.

9. The device of claim 1 wherein the generally vertically oriented handle members are of adjustable length.

10. A personal lifting device for use with an article of furniture having a surface on which a person can sit and a firm edge along a side of the article below the surface spaced a distance from a floor surface on which the article of furniture is resting so as to define a gap between the firm edge and said floor surface, the personal lifting device comprising:

a pair of spaced-apart generally vertically oriented handle members each having an upper aspect defining generally horizontally extending handles and a lower aspect;

a pair of generally horizontal supports each having a generally horizontal bottom edge and a forward aspect connected to the lower aspect of a respective handle member so as to define a junction having a portion extending generally vertically and a portion extending generally horizontally, each support also having a rearward aspect, the supports sized to be received through said gap to extend under said surface of said article of furniture with the forward aspects adjacent the firm edge and the rearward aspects extending rearwardly therefrom and along said floor surface;

a pair of mounting units each being secured to and extending forwardly of a respective junction; and a pair of adjustable legs each being associated with a respective mounting unit so as to extend to said floor surface forwardly of the portion of the junction extending generally horizontally such that the forward aspects of the supports are held off said floor surface by a distance determined by adjustment of the legs whereby to facilitate positioning the forward aspects in close proximity to said firm edge.

11. The device of claim 10, each adjustable leg having a portion exposed below the mounting unit to facilitate adjusting the leg from below.

12. The device of claim 11, each mounting unit having an access aperture situated so as to provide adjustment access to its associated adjustable leg to facilitate adjusting the leg from above.

13. The device of claim 10, each mounting unit having an access aperture situated so as to provide adjustment access to its associated adjustable leg to facilitate adjusting the leg from above.

14. The device of claim 10 wherein the junction is made of a continuous piece of tubing bent to have a substantially continuous radius.

15. The device of claim 10 wherein the generally horizontal supports are connected by at least one cross member of adjustable length.

* * * * *